US005470450A

United States Patent [19]

Tanaka et al.

[11] Patent Number: 5,470,450

[45] Date of Patent: * Nov. 28, 1995

[54] EDGE PROTECTOR FOR ELECTROLYTIC ELECTRODE, AND SPREADER BAR

[75] Inventors: Hiroshi Tanaka; Yasuo Masuda, both of Tokyo, Japan

[73] Assignee: Mitsubishi Materials Corporation, Tokyo, Japan

[ * ] Notice: The portion of the term of this patent subsequent to Nov. 29, 2011, has been disclaimed.

[21] Appl. No.: 296,510

[22] Filed: Aug. 26, 1994

Related U.S. Application Data

[63] Continuation-in-part of Ser. No. 49,984, Apr. 20, 1993, Pat. No. 5,368,714.

[30] Foreign Application Priority Data

| | | | |
|---|---|---|---|
| Apr. 20, 1992 | [JP] | Japan | 4-099939 |
| Apr. 20, 1992 | [JP] | Japan | 4-099940 |
| Apr. 20, 1992 | [JP] | Japan | 4-099941 |
| Apr. 20, 1992 | [JP] | Japan | 4-099942 |

[51] Int. Cl.[6] ..... C25C 7/08

[52] U.S. Cl. ..... 204/279; 204/281

[58] Field of Search ..... 204/279, 281

[56] References Cited

U.S. PATENT DOCUMENTS

| | | | |
|---|---|---|---|
| 3,798,151 | 3/1974 | Takamura et al. | 204/281 |
| 4,080,279 | 3/1978 | Poush et al. | 204/288 X |
| 4,137,130 | 1/1979 | Willans | 204/281 X |
| 4,406,769 | 9/1983 | Berger | 204/281 |
| 4,776,928 | 10/1988 | Perlich | 204/281 X |
| 5,314,600 | 5/1994 | Webb et al. | 204/281 X |

*Primary Examiner*—Donald R. Valentine

*Attorney, Agent, or Firm*—Peter Jon Gluck; Morrison Law Firm; Vineet Kohli

[57] ABSTRACT

An edge protector for an electrolysis electrode onto which a thick-electrodeposited copper product is deposited for producing an electrolytic copper product, has an outer surface shape in the central portion thereof which reduces the thickness in that portion to improve uniformity of cooling, and thereby reduce stress cracking as a result of the reduced buildup of thermal stresses. The outer surfaces may be inclined planes or suitable curved shapes that converge from an outer jaw toward an inner jaw. In one embodiment an edge protector is taught such that its top end is angled downward from its center outward at an angle of less than twenty degrees to prevent creation of sharp edges and difficulty in removal. A spreader bar has a shape which enables clamping of the edge protector onto an electrolysis electrode without excessive expansion of the outer jaw, thereby lengthening service life, and easing installation. Both a hollowed and a tapered spreader bar are taught for end insertion.

10 Claims, 9 Drawing Sheets

EDGE PROTECTOR FOR ELECTROLYTIC ELECTRODE, AND SPREADER BAR

This is a continuation-in-part of U.S. Ser. No. 08/049,984 filed 20 Apr. 1993, now U.S. Pat. No. 5,368,714, and entitled EDGE PROTECTOR FOR ELECTROLYTIC ELECTRODE, SPREADER BAR THEREOF AND METHOD OF ATTACHING SAME TO ELECTROLYTIC ELECTRODE, which was allowed on 17 May 1994, and for which the issue fee was paid 17 Aug. 1994, and is still pending.

The present invention relates to an edge protector for an electrolytic electrode and, more particularly, to an edge protector which is attached to protect the edge of an electrode used for electrolysis during the electrolytic refining of metals, including copper.

In industrial electrolysis processes, in general, protectors are attached to the edge of electrodes to prevent contact of the cathode and anode and in order to facilitate stripping of electrodeposits from the electrode.

Such protectors are disclosed, for example, in Japanese Utility Model Provisional Publication No. 3-67,067, ditto No. 3-67,068, Japanese Utility Model Publication No. 51-4, 964, whose U.S. counterpart is U.S. Pat. No. 3,798,151, and U.S. Pat. No. 4,406,769.

Conventional technology will be described further in detail with reference to electrolytic refining of copper as an example.

When electrolytically refining copper, in general, a pure copper sheet having a thickness of from 0.5 to 1.0 mm (hereinafter referred to as a "starting sheet") is used as the cathode. It is conventional practice to manufacture a starting sheet, as shown in FIGS. 11 and 12, by electrolysis using an anode 1 of raw copper and a cathode consisting of mother blank 2 of stainless steel. These elements are placed in an electrolytic cell for electrodeposition of pure copper onto the surface of the mother blank 2. The deposited copper is later stripped off the mother blank 2. During the above process, an insulating edge protector 3A is attached to the mother blank bottom, and edge protectors 3B are attached to the lateral edges of the mother blank 2. Edge protectors 3A and 3B prevent the deposition of copper over the bottom and edges of the mother blank 2. This facilitates stripping of the staffing sheet from the mother blank 2. In addition, the presence of edge protectors 3A and 3B help avoid accidental direct physical contact between the anode 1 and the cathode (not shown).

Edge protectors of the prior art have been conceived in numerous shapes such as, for example, the shapes shown in FIGS. 13 and 14. In FIG. 13, a bottom edge protector 10 is shown corresponding to bottom edge protector 3A in FIG. 12. In FIG. 14, a side edge protector 11' is shown corresponding to side edge protector 3B in FIG. 12. In both cases, an inner jaw 12 provides for attachment of the mother blank 2 to a side 11 of the edge protector 10 (10'). Inner jaw 12 is disposed in the longitudinal direction of its edge protector 10 (10'). A semi-circular outer jaw 15 is formed in the longitudinal direction on the other side 13 of the edge protector 10 (10'). A conventional round spreader bar 14 has an outside diameter that is slightly larger than the inside diameter of the outer jaw 15. By fitting the spreader bar 14 into the outer jaw 15 after inserting the edge of the mother blank 2 into the inner jaw 12, the width of the inner jaw 12 is reduced, thus firmly clamping the edge protector 10 (10') onto the mother blank 2.

The prior-art edge protector having the above-mentioned shape is easily broken during service.

In the conventional protector described above, furthermore, the usual practice has been to insert the mother blank 2 into the inner jaw 12 of the edge protector 10 by first affixing a sealing tape to the edge of the mother blank 2, inserting the mother blank 2 into the inner jaw 12, and applying a masking agent such as a silicone coating agent between the mother-blank 2 and the edge protector 10 for sealing. This sealing operation requires a great amount of labor, and thus reduces the productivity of the overall process.

In addition, since the spreader bar 14 has a diameter exceeding the diameter of outer jaw 15, forcing the spreader bar 14 into the outer jaw 15 expands the opening of the outer jaw 15 to a width equal to the outside diameter of the spreader bar 14. This expands the outer jaw 15 an amount exceeding the amount necessary for the clamping function, and results in an excessive force exerted on the edge protector.

OBJECTS AND SUMMARY OF THE INVENTION

With a view to overcoming the above-mentioned drawbacks of the conventional technology, an object of the present invention is to provide an edge protector which permits improvement of radiation properties in resin-forming, effective inhibition of thermal stress produced by resin-forming, and an improvement of stress corrosion cracking resistance of materials for the edge protector used for an electrolysis electrode onto which copper and other metals are electrodeposited.

Another principal objective of the present invention is to provide an edge protector produced such that its top end is angled downward from its center outward at an angle of less than twenty degrees to prevent creation of sharp edges and difficulty in removal.

It is a further object of the invention to provide an edge protector which permits simplification of sealing operation between the electrode for electrolysis and the edge protector, improvement of operability, and ensurement of a satisfactory sealing with the electrode.

It is a still further object of the invention to provide a spreader bar for an edge protector which prevents excessive force from acting on the edge protector, and which permits smooth and certain attachment of the edge protector to the electrode.

It is a still further object of the invention to provide a method for attaching the edge protector to the electrode for electrolysis, which prevents excessive force from acting on the edge protector, and which permits smooth and certain attachment of the edge protector to the electrode.

To achieve the above-mentioned objects, the present invention provides an edge protector having a shape effective to minimize the thickness by means of a pair of outer surfaces designed to converge from the outer jaw side toward the inner jaw side and an arcuate concave formed on the middle portion of each of these outer surfaces, and the edge protector to the electrode for electrolysis with the use of the improved spreader bar.

Briefly stated, the present invention provides an edge protector for an electrolysis electrode, said electrolysis electrode being an electrode plate onto which a thick-electrodeposited copper product is deposited for producing an electrolytic-copper product, having an outer surface shape in the central portion thereof which reduces the thickness in that portion to improve uniformity of cooling, and thereby reduce stress cracking as a result of the reduced buildup of thermal stresses. The outer surfaces are inclined planes or suitable curved shapes that converge from an outer jaw toward an inner jaw. In one embodiment an edge protector is taught such that its top end is angled downward from its center outward at an angle of less than twenty degrees to prevent creation of sharp edges in the product and difficulty in removal from the product. Additionally, a hollowed spreader bar is taught lowering production costs and reducing manpower required for insertion and removal. Both a hollowed and a tapered spreader bar are taught for end insertion.

According to an embodiment of the invention, there is provided an edge protector for an electrolysis electrode comprising, an inner jaw disposed in a longitudinal direction of the edge protector at a first end, an outer jaw disposed in a longitudinal direction of the edge protector at a second end, a first surface extending along a first side of the edge protector, a second surface extending along a second side of the edge protector, the first and second surfaces converging toward each other in a direction from the outer jaw toward the inner jaw, to reduce an amount of material in locations between the first and second surfaces sufficiently to reduce thermal stresses in these locations, the first end further comprising opposing top and bottom portions of the inner jaw, wherein each of the top and the bottom portion is angled upward from the first to the second surface, the angle from the first surface of the edge protector to the second surface being an angle which is less than about twenty degrees, formed at each of the opposing top and bottom portion of the inner jaw, at a first end of the edge protector, the angled first end of the edge protector effective for preventing unintended sharpening of the deposited electrolytic copper contacting the first end during electrolysis, and the edge protector is capable of ready removable detachment from the electrolysis electrode.

According to a feature of the invention, there is provided an edge protector for an electrolysis electrode comprising; an inner jaw disposed in a longitudinal direction of the edge protector, an outer jaw disposed in a longitudinal direction of the edge protector, and a hollowed spreader bar, the bar having a hollowness disposed in a longitudinal direction, the hollowed spreader bar capable of ready removable insertion into, and detachment from, the edge protector.

According to a still further feature of the invention, there is provided an edge protector of an electrolysis electrode for producing an electrolytic metal product comprising, an inner jaw disposed in a longitudinal direction of the edge protector at a first end, an outer jaw disposed in a longitudinal direction of the edge protector at a second end, a first surface extending along a first side of the edge protector, a second surface extending along a second side of said edge protector, the first and second surfaces converging toward each other in a direction from the outer jaw toward the inner jaw, to reduce an amount of material in locations between the first and second surfaces sufficiently to reduce thermal stresses in these locations, the first end further comprising opposing top and bottom portions of the inner jaw, wherein each of the top and said bottom portions is angled downward from the first surface of said edge protector to the second surface, such that at an angle which is less than about twenty degrees is formed at a first end of the edge protector, at each said opposing top and bottom portion of the inner jaw, from each first surface to each second surface of each portion from the center portion of the edge protector outward, the angled first end of the edge protector effective for preventing unintended sharpening of the deposited electrolytic copper contacting the first end during electrolysis.

The above, and other objects, features and advantages of the present invention will become apparent from the following description read in conjunction with the accompanying drawings, in which like reference numerals designate the same elements.

DETAILED DESCRIPTION OF PREFERRED EMBODIMENTS

Figure 2:
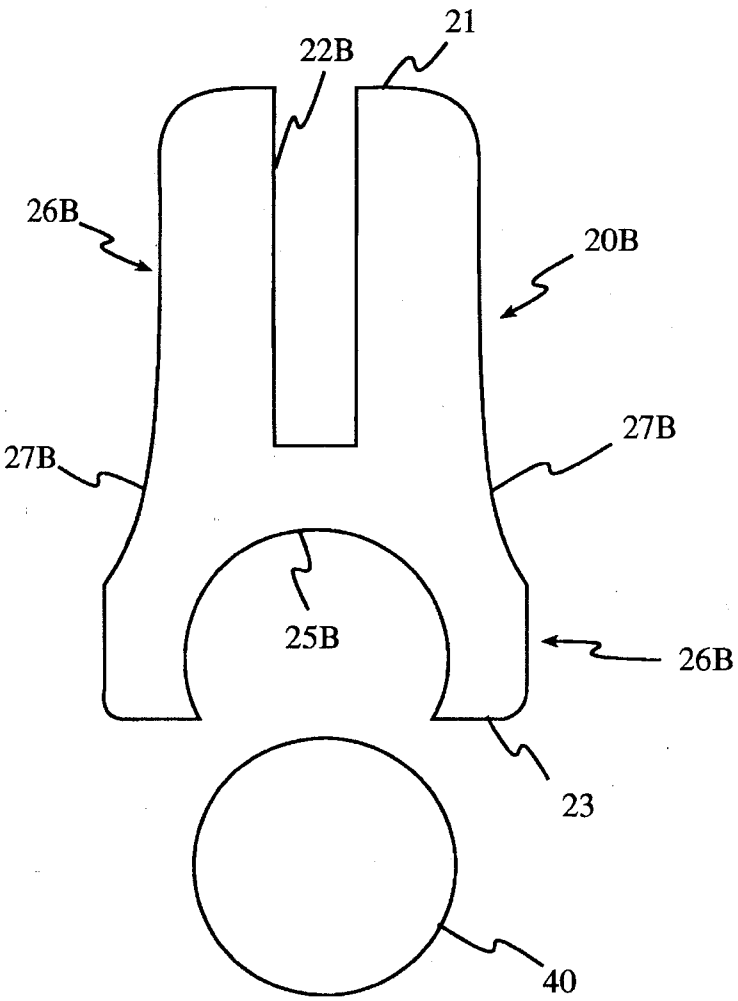
FIG. 2 is a side view illustrating an embodiment of the edge protector for side of the present invention.
Figure 1:
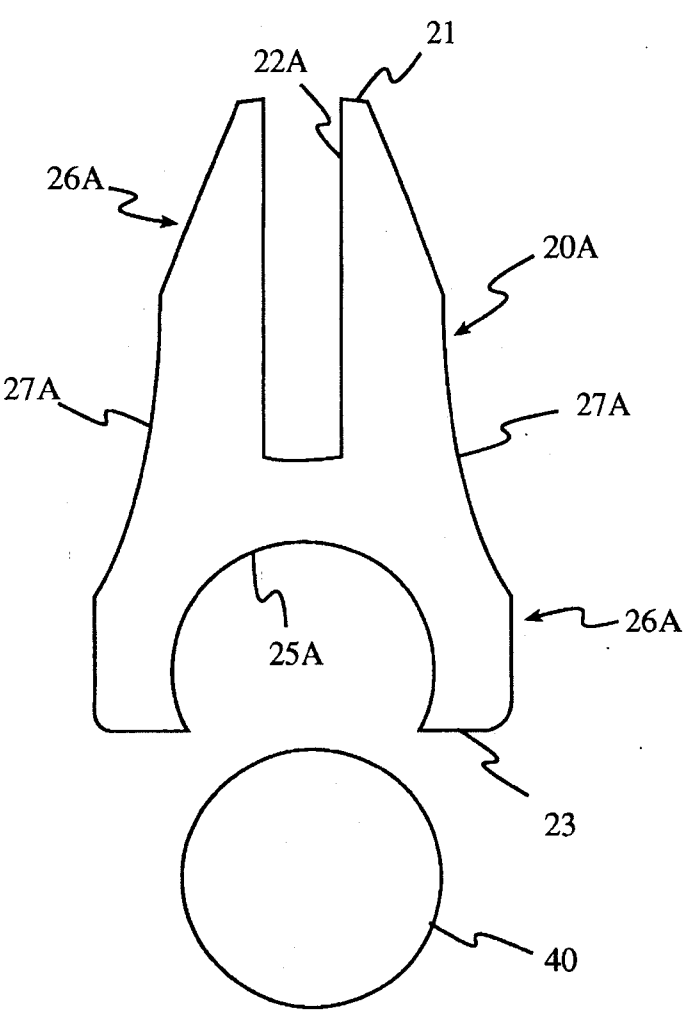
FIG. 1 is a side view illustrating an embodiment of the edge protector for bottom of the present invention.

Referring to FIGS. 1 and 2, edge protectors 20A and 20B are made of a suitable synthetic resin such as, for example, polyphenyleneether and high-impact polystyrene resin as main constituents; commercial products including "IUPI-ACE" (trade name) manufactured by Mitsubishi Gas Chemical Co., Inc.). The protectors 20A and 20B are formed by extrusion forming.

An inner jaw 22A or 22B for attaching a mother blank is formed in the longitudinal direction on a side 21 of the edge protectors 20A or 20B. Semi-circular outer jaws 25A and 25B are disposed in the longitudinal direction on the other sides 23 of the edge protectors 20A and 20B. Outer jaws 25A and 25B are sized for engaging a spreader bar 40.

A pair of outer surfaces 26A and 26B extending along the outer sides of the edge protectors 20A and 20B containing the respective inner jaws 22A and 22B and outer jaws 25A and 25B formed thereon. The outer surfaces become narrower from the outer jaws 25A and 25B toward the inner jaws 22A and 22B. An arcuate concave surface 27A forms a central part of outer surface 26A of edge protector 20A. A flat inclined surface 27B forms a central part of the outer surface 26B of edge protector 20B.

Figure 12:
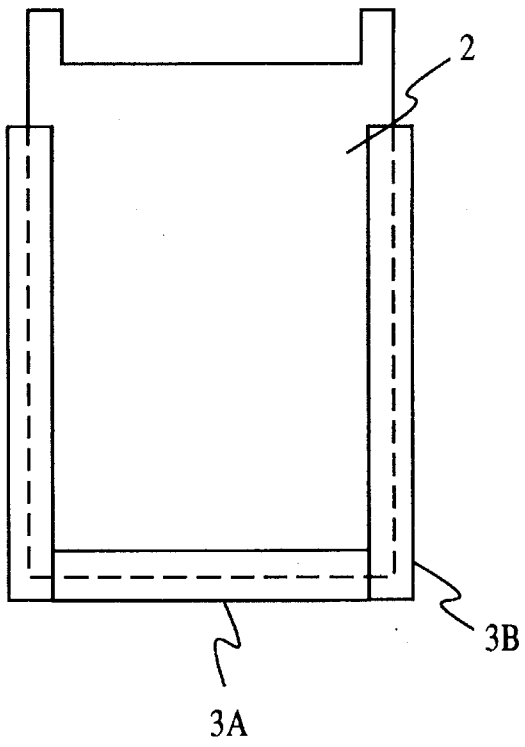
Fig. 12 PRIOR ART
FIG. 12 is a front view illustrating an electrode to which is attached the conventional edge protector.
Figure 11:
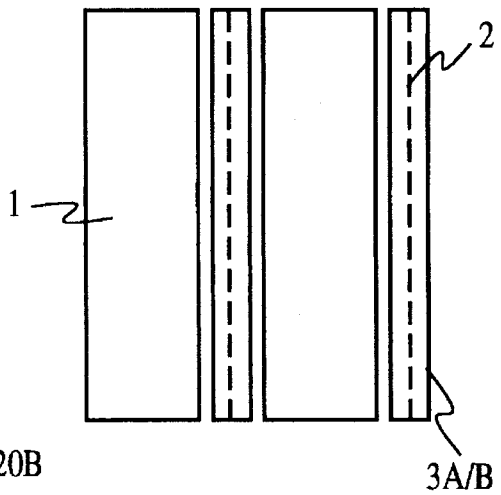
Fig. 11 PRIOR ART
FIG. 11 is a side view illustrating an electrolytic electrode.
Figure 10:
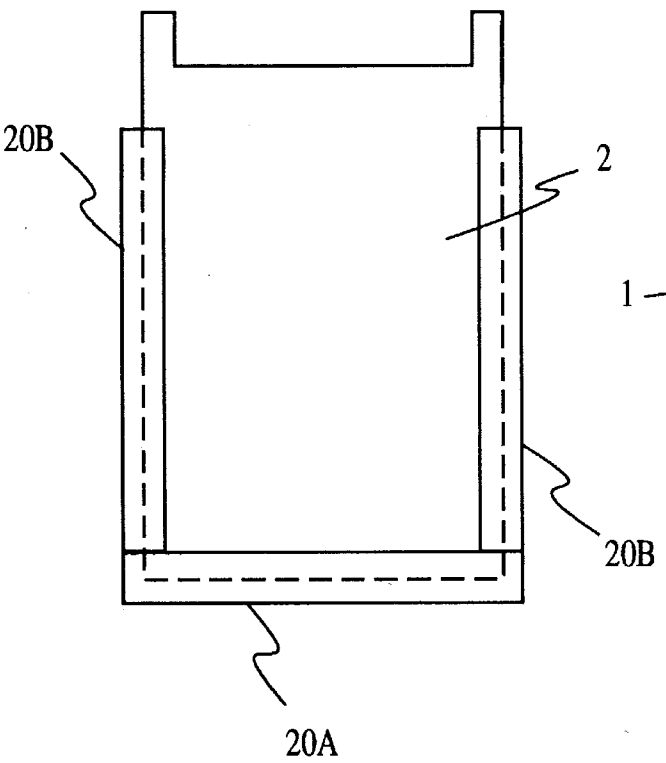
FIG. 10 is a front view illustrating an electrode to which is attached the edge protector of the present invention.
Figure 14:
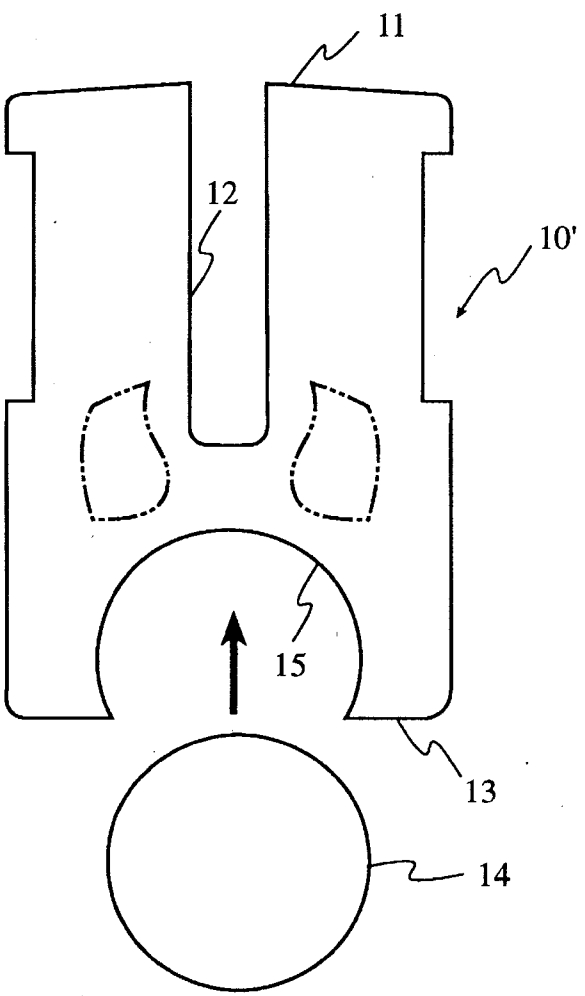
Fig. 14 Prior Art
FIG. 14 is a side view illustrating the conventional edge protector for side.
Figure 13:
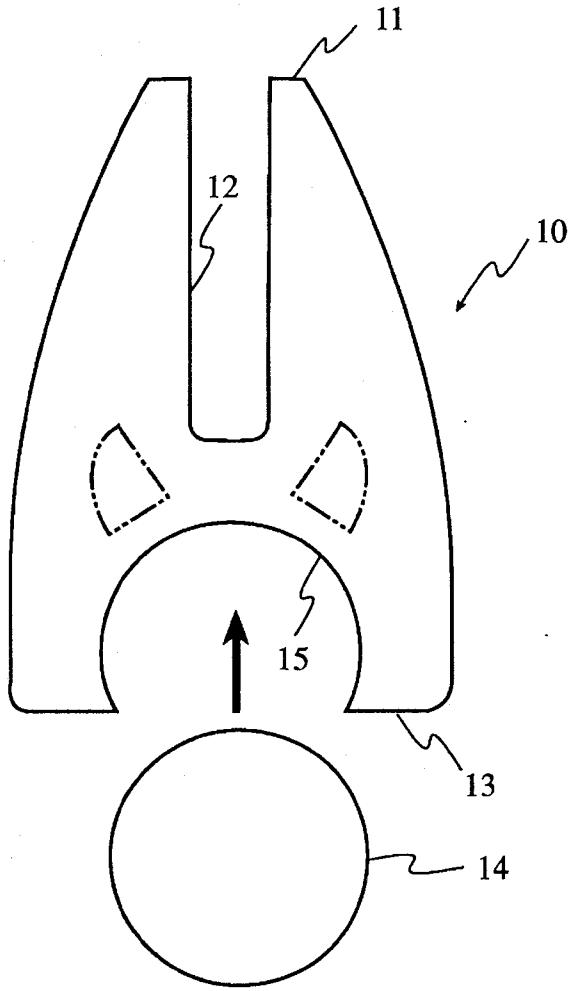
Fig. 13 Prior Art
FIG. 13 is a side view illustrating the conventional edge protector for bottom.
Figure 18:
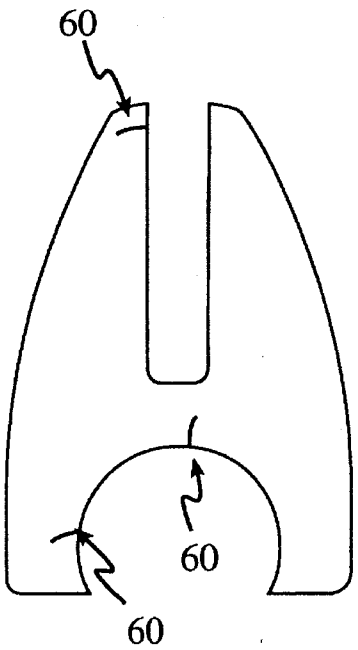
FIG. 18 is a descriptive view illustrating a position where cracking occurs in (*4) in Table 2.
Figure 17:
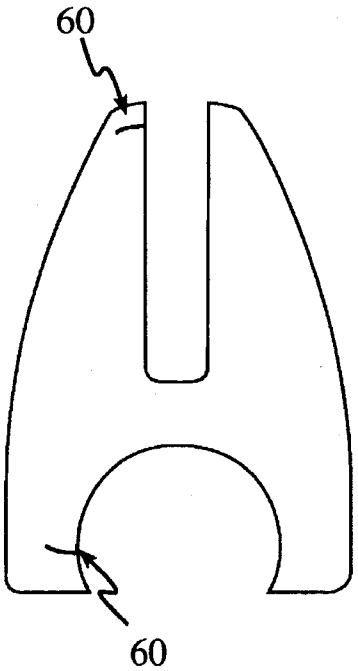
FIG. 17 is a descriptive view illustrating a position where cracking occur in (*3) in Table 2.
Figure 16:
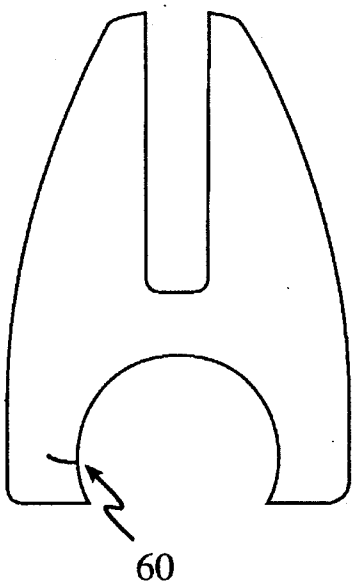
FIG. 16 is a descriptive view illustrating a position where cracking occurs in (*2) in Table 2.
Figure 15:
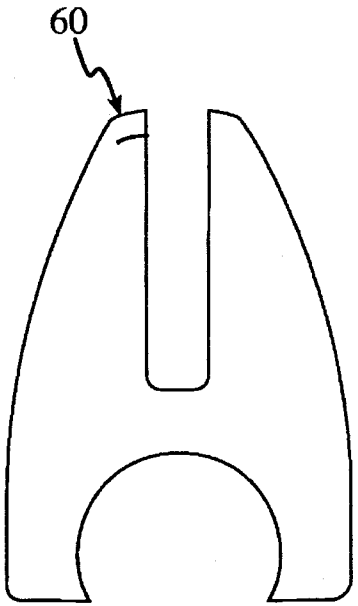
FIG. 15 is a descriptive view illustrating a position where cracking occurs in (*1) in Table 2.

The above-mentioned construction is based on the following findings resulting from clarification of the cause of each breakage of the conventional edge protector, carried out by the present inventors. An edge protector of the conventional shape of FIGS. 12 and 13, resin-formed by extrusion-forming, tends to accumulate thermal stress in the interior of the thick portion during natural cooling. To complicate matters, when an organic solvent such as a stripping agent used to assist in stripping of the starting sheet from the mother blank, comes into contact with the edge protector that contains residual thermal stress in its interior (the portions surrounded by two-point chain lines in FIGS. 13 and 14 represent portions with maximum residual stress), stress corrosion cracking tends to occur in this portion with maximum residual stress.

For the embodiments of the edge protector having a construction as described above (FIGS. 1 and 2) and comparative cases (FIGS. 13 and 14), radiation cooling properties during cooling from a uniform temperature distribution upon leaving the sizing die to room temperature (20° C.) were measured using thermal conductivity analysis. The results of thermal stress analysis based on these tests are shown in Table 1. In Table 1, the results are based on an analysis carried out under conditions including a sizing die temperature of 75° C., an initial resin temperature of 280° C. and a die holding time of 24 seconds. Also in Table 1, the maximum temperature in the resin at the time the part left the sizing die (after a die residence time of 24 seconds) is shown as the maximum temperature, and the maximum value of residual tensile stress at room temperature is shown as the maximum thermal stress. The values shown in Table 1 as the decrease in gap are for comparing values of deviation from the design dimensions of the difference in width between the tip portion and the other end portion of each of the inner jaw 22A and 22B (deformation of each of the inner jaws 22A and 22B). Attachability when attaching the mother blank to each of the inner jaws 22A and 22B can be assessed from this comparison.

As is clear from Table 1, remarkable improvements were observed in all the items including maximum temperature, maximum thermal stress and decrease in the gap. More particularly, by minimizing the thickness of the thick portion by means of the pair of outer surfaces 26A and 26B provided so as to converge from the outer jaws 25A and 25B side toward the inner jaws 22A and 22B side, and the arcuate concave 27A and/or the flat slope 27B formed in the middle portions of these outer surfaces 26A and 26B, it was found possible not only to inhibit the decrease in the gap during extrusion forming (deformation of the portions of the inner jaws 22A and 22B), but also to improve radiation cooling properties, and to reduce thermal stresses remaining in the interior. For the case where the above-mentioned bar 20A was actually extrusion-formed, variation in size accuracy of the width of the inner jaw 22A (design size: 3.2 mm) were measured: variations were within a range of from 3.20 mm to 3.38 mm. For the conventional protector 10, in contrast, variations in the width of the inner jaws (design size: 3.3 mm) were within a wider range of from 3.2 mm to 3.5 mm.

As a result of actual application of these results of analysis and data, it was possible, when attaching the mother blank into each of the inner jaws 22A and 22B, to prevent excessive force from acting on this portion while achieving smooth attachment. Simultaneously with this, it was possible to improve stress corrosion cracking resistance of the material, thus substantially extending the service life of the edge protector. The results of a heat cycle test representing this effect are shown in Table 2.

The figures shown in Table 2 represent the results of the condition of samples which comprised attaching each of the conventional samples shown in FIG. 13 (samples 1-1 to 1-4 and 2-1 to 2-4) and samples of the invention shown in FIG. 1 (samples 3-1 to 3-4 and 4-1 to 4-4) to each of the four sides of a rectangular stainless steel mother blank, immersing same into a stripping agent, and cycling the temperature repeatedly in a heat cycle consisting of heating from 23° C. to 65° C. over 30 minutes, holding at 65° C. for four hours, cooling to 23° C. over 30 minutes, and then holding at 23° C. for four hours.

Initially the stripping agent included 216 g of ELECUT (trade name) manufactured by HOKKO Chemical Co. and 1.8 ml of CHELEX LT-3 (trade name) manufactured by Sakai Chemical Industry Co. in 18 liters of the stripping agent. To accelerate the reaction, however, in the 59th cycle and thereafter, the concentration was changed to one comprising 216 g of ELECUT and 3.0 ml of CHELEX LT-3 in 18 liters of the stripping agent. The samples 1-1 to 1-4, 2-1 to 2-4, and 3-1 to 3-4 were made of IUPIACE AH-60 manufactured by Mitsubishi Gas Chemical Co., Inc., and the samples 4-1 to 4-4 were made of IUPIACE AN-91 (containing polyphenylene ether in a larger amount than in IUPIACE AH-60, and having improved tensile strength and impact strength). In Table 2, the symbol 0/3 represents a test result in which no cracks are produced in any of three samples, i.e., in normal condition; 1/3 means that cracks occurred in one sample from among three samples; and 2/3 means similarly that cracks occurred in two of three samples. In Table 2, furthermore, the symbols (*1) to (*4) indicate that cracks 60 occurred at positions shown in FIGS. 15 to 18.

As is clear from Table 2, while no abnormality was observed even after 235 cycles in the samples of the invention (samples 3-1 to 3-4 and 4-1 to 4-4), cracks began to appear after 80 cycles in the conventional samples (samples 1-1 to 1-4 and 2-1 to 2-4). The testing was discontinued after 192 cycles because of the occurrence of many cracks.

Figure 3B:
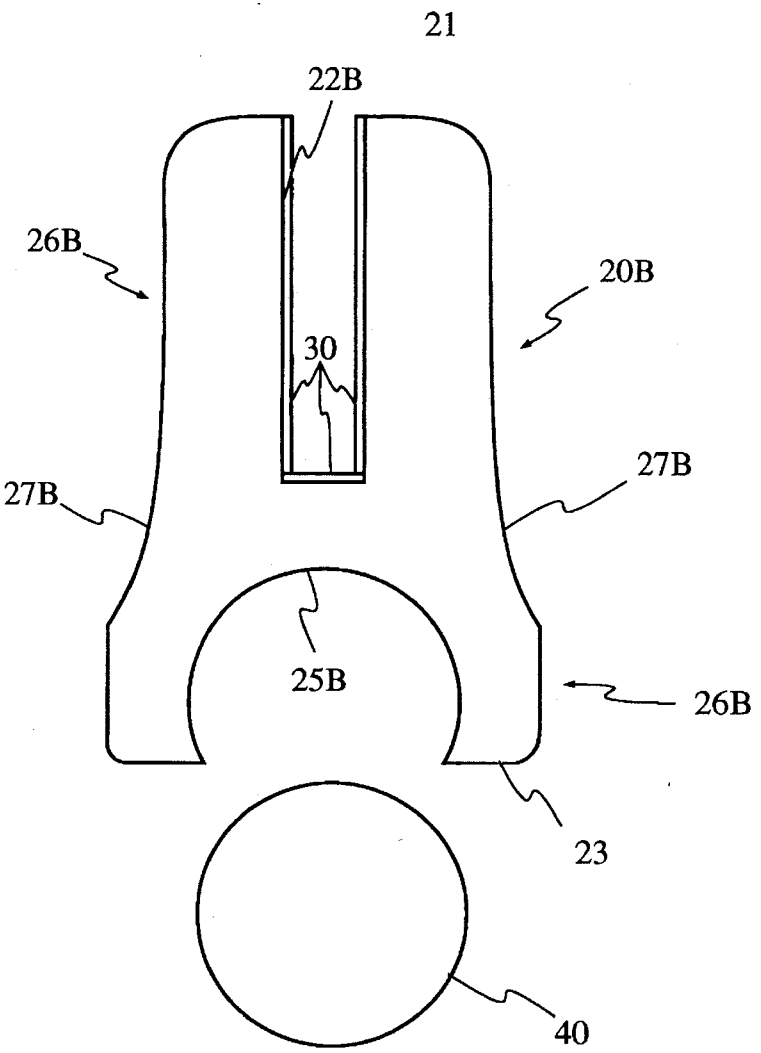
FIG. 3*b* is a side view illustrating an example of attachment of the side sealing member.
Figure 3A:
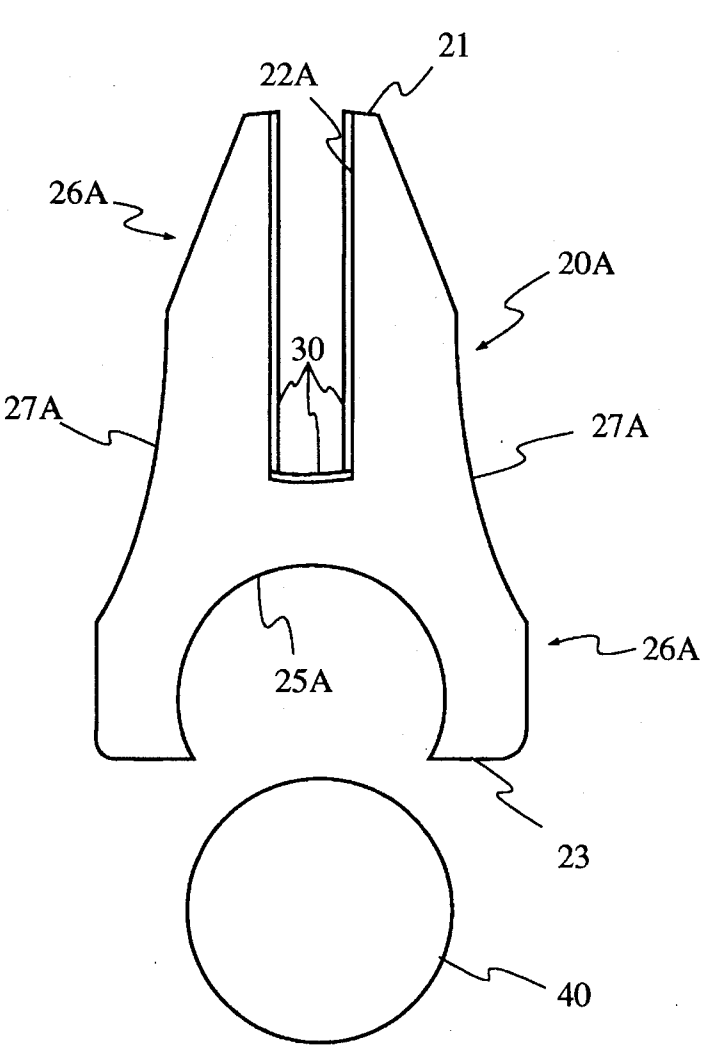
FIG. 3*a* is a side view illustrating an example of attachment of the bottom sealing member.

Referring to FIGS. 3*a* and 3*b*, a sealing member 30 using, for example, a rubber elastic material such as silicone rubber is affixed to the inner jaw 22A with an adhesive. FIG. 3*a* shows an embodiment of the edge protector for bottom, and FIG. 3*b* shows an embodiment of the edge protector for side. When the spreader bar 40, having a diameter slightly larger than that of an outer jaw 25A, is inserted into the outer jaw 25A, close contact of the sealing member 30 with the inner jaw 22A and with the mother blank is ensured when the mother blank is clamped.

Figure 4:
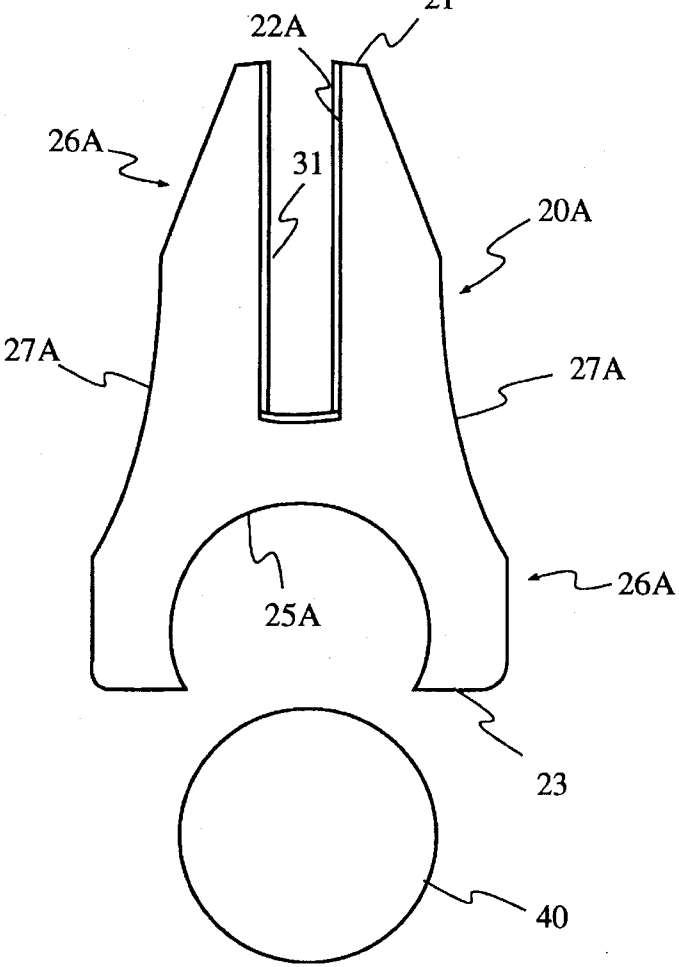
FIG. 4 is a side view illustrating another example of attachment of the sealing member.

Referring now to FIG. 4, a synthetic resin edge protector 20A has an integral sealing member 31 of soft vinyl chloride integrally formed with the edge protector 20A during extrusion-forming of the edge protector 20A.

Figure 5:
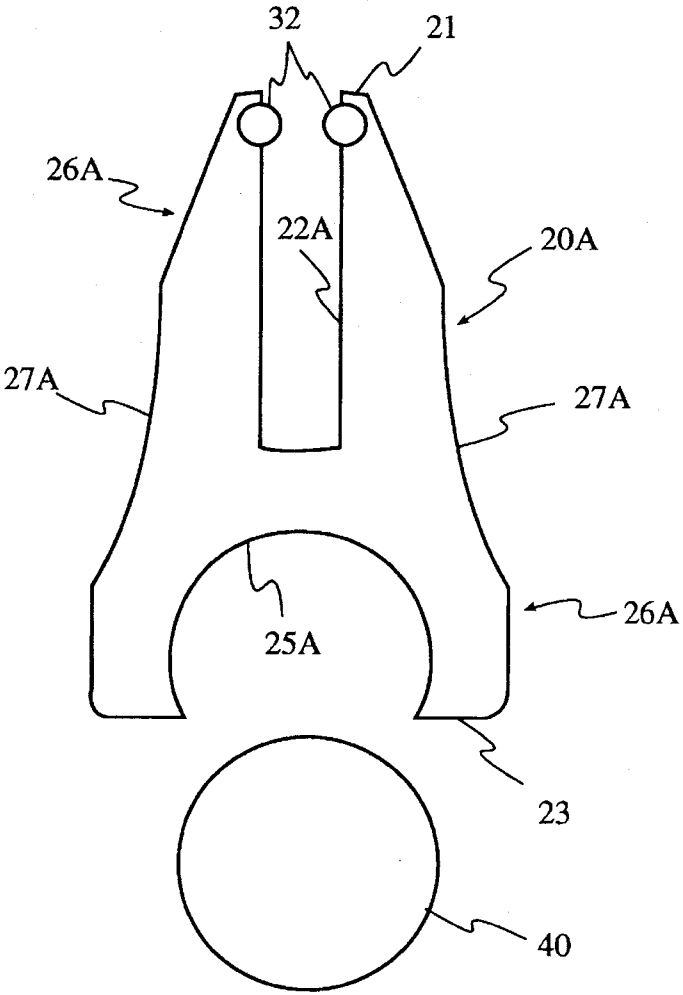
FIG. 5 is a side view illustrating further another example of attachment of the sealing member.

Referring now to FIG. 5, a further embodiment of the invention includes a sealing member 32 such as neoprene rubber glued into the tip of the inner jaw 22A. When clamping is performed, the sealing member 32 is compressed, thus providing sealing with the mother blank. This embodiment reduces the amount of the sealing material required.

Figure 6:
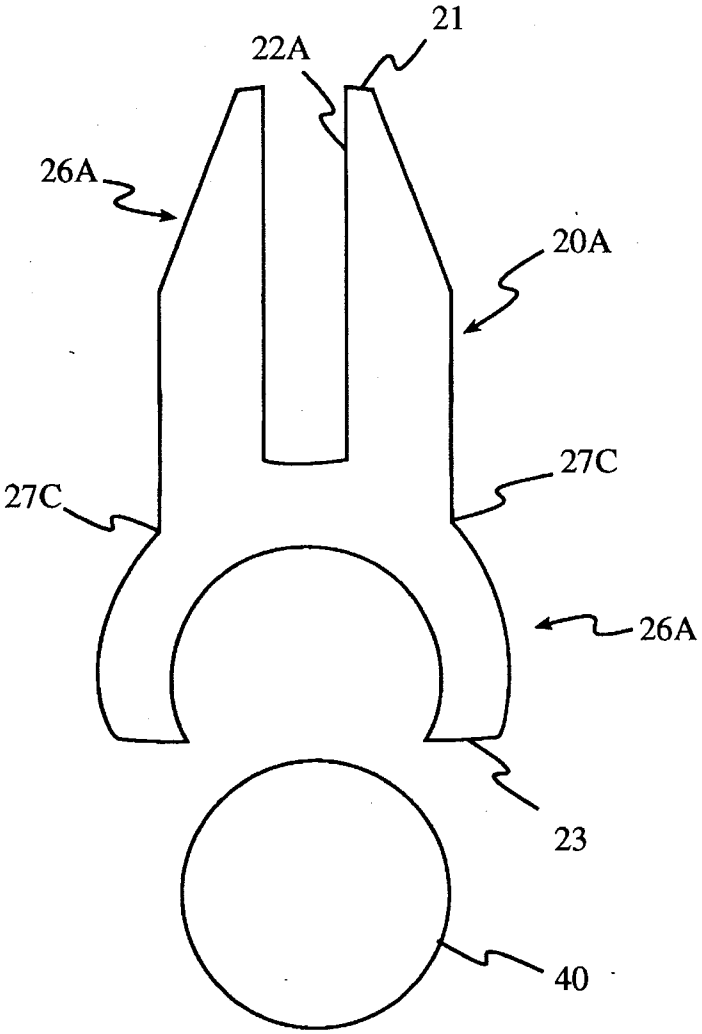
FIG. 6 is a side view illustrating another embodiment of the edge protector for bottom of the present invention.

The edge protector for bottom has been explained above with reference to FIGS. 4 and 5. The same techniques are equally applicable to the edge protector for side, and thus further description thereof is considered to be unnecessary. The above description covers the edge protector with an arcuate concave surface 27A. However, it must be realized that an angled concave surface 27C as shown in FIG. 6 falls within the spirit and scope of the invention. In general, it is important to reduce the thickness of material at this portion as far as possible to bring the thickness of various portions of the edge protector closer to a uniform thickness.

As described above, the present invention provides an edge protector for an electrode for electrolysis, which is attached to the both side edges or to the lower edge of the mother blank for the protection of edges of the mother blank, in which an inner jaw for attachment of the mother blank is formed on a side surface of a bar in the longitudinal direction of the edge protector, an outer jaw for engaging with a spreader bar is formed on the other side of the edge protector in the longitudinal direction of the edge protector, a pair of outer surfaces which are extensions of the both side surfaces of the edge protector having the above-mentioned inner jaw and outer jaw formed thereon are set so as to converge from the outer jaw side toward the inner jaw side, and a concave and/or a flat slope is formed in the middle portion of each of the outer surfaces in the longitudinal direction of the edge protector. Accordingly, by achieving the smallest possible thickness of the thick portion under the effect of the pair of outer surfaces designed so as to converge from the outer jaw side toward the inner jaw side, and the concave and/or the flat slope, it is possible to inhibit deformation during resin forming, and improve attachability of the mother blank to the inner jaw. Simultaneously with this, it is possible to improve the radiation property, and to inhibit thermal stress produced during natural cooling in resin forming, thus permitting remarkable improvement of stress corrosion cracking resistance of the material.

Figure 7:
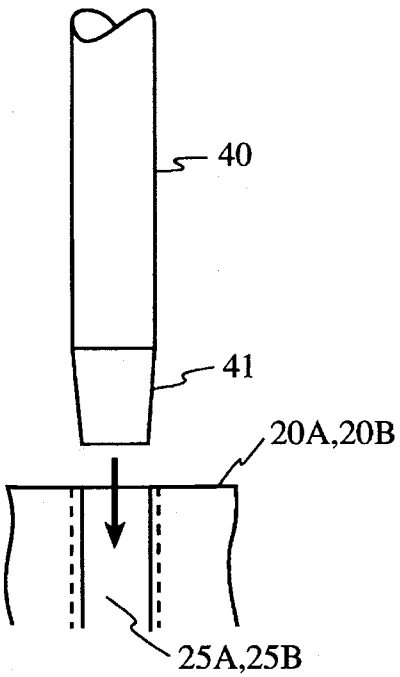
FIG. 7 is a side view illustrating an embodiment of the spreader bar of the present invention.

Referring now to FIG. 7, a spreader bar 40 for an edge protector 20A (or 20B) has a diameter slightly larger than that of the outer jaws 25A and 25B. The spreader bar 40 has a tapering portion 41 formed at its tip.

The sealing member 30 (FIGS. 3*a* or 3*b*) is attached to the inner jaws 22A and 22B the spreader bar 40 is inserted into the outer jaws 25A and 25B in the longitudinal direction with the tapering portion 41 entering first. The mother blank is firmly clamped in the inner jaws 22A and 22B, and at the same time, the sealing member 30 is brought into close contact with the inner jaws 22A and 22B and the mother blank therebetween, thus ensuring satisfactory sealing there. In this case, because the spreader bar 40 is inserted with the tapering portion 41 leading in the longitudinal direction into each of the outer jaws 25A and 25B, the spreader bar 40 is smoothly inserted into each of the outer jaws 25A and 25B which are therefore expanded. In addition, outer jaws 25A and 25B are expanded only as much as necessary to perform the clamping function, and not over-expanded, as is the case with prior-art embodiments.

Figure 8:
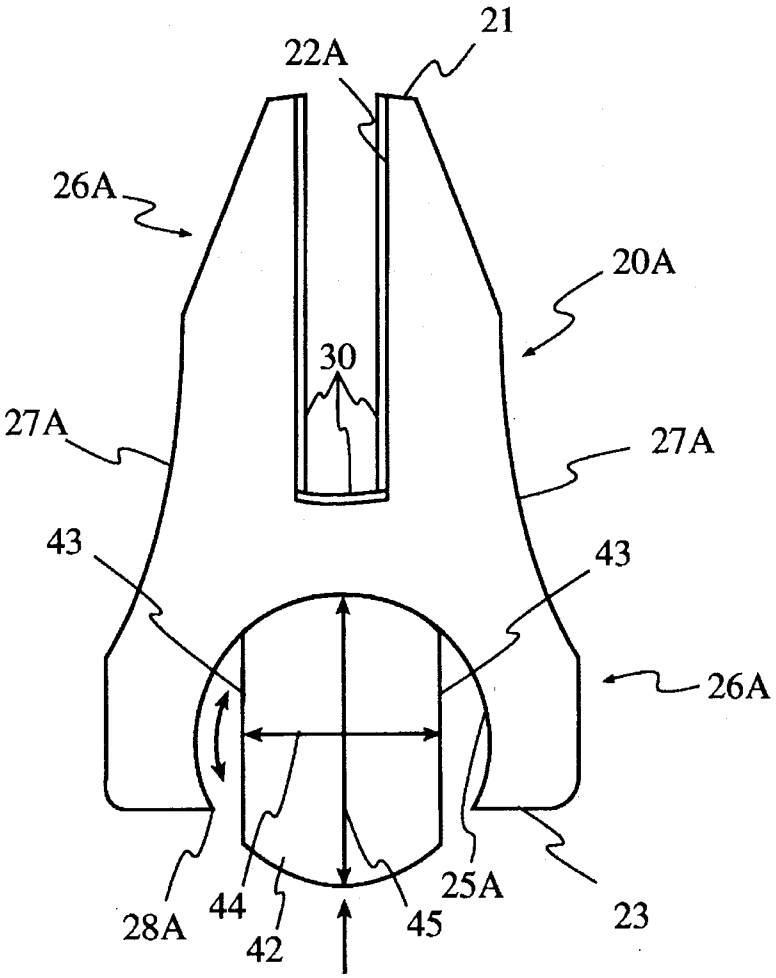
FIG. 8 is a side view illustrating another embodiment of the spreader bar of the present invention.

Referring now to FIG. 8, a cylindrical spreader bar 42 includes a pair of parallel flat surfaces 43 thereon. The distance 44 (narrow portion) between the two flat surfaces 43 of the spreader bar 42 is smaller than the width of the opening 28A of the outer jaw 25A. The outside diameter 45 (wide portion) of the spreader bar 42 is slightly larger than the inside diameter of the outer jaw 25A. The width of the opening 28A is smaller than the inside diameter of the outer jaw 25A. The spreader bar 42 is inserted into the outer jaw 25A with the circumferential face of the spreader bar 42 facing toward the opening 28A of the outer jaw 25A. Then the spreader bar 42 is rotated about its axis by a prescribed angle to attache the spreader bar 42 firmly in the outer jaw 25A. The outer jaw is smoothly expanded with a force within an appropriate range. The mother blank is thus firmly secured in the inner jaw 22A. In place of the cross-sectional shape shown in FIG. 8, the spreader bar may have an elliptical cross-section (not shown).

Figure 9:
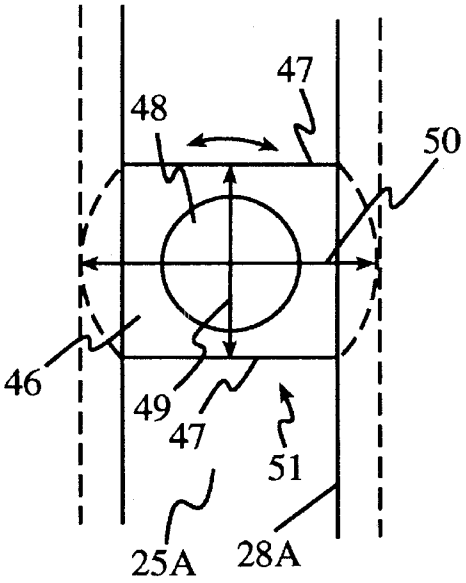
FIG. 9 is a side view illustrating further another embodiment of the spreader bar of the present invention.

Referring now to FIG. 9, a pair of parallel flat surfaces 47 parallel are formed on a sphere having a diameter slightly larger than the inside diameter of the outer jaw 25A. A supporting member 48 having an axis parallel to the flat surfaces 47 is attached to the sphere 46. The distance 49 (narrow portion) between the flat surfaces 47 of the sphere 46 is smaller than the width of the opening 28A of the outer jaw 25A, and the outside diameter 50 (wide portion) of the sphere 46 is slightly larger than the inside diameter of the outer jaw 25A. By rotating sphere 46, sphere 46 engages the outer jaw 25A while directing the flat surfaces 47 of a plurality of spreader bars 51 along the opening 28A of the outer jaw 25A, and then turning each supporting member 48 around the axis thereof by a prescribed angle, the sphere 46 pushes open the outer jaw 25A smoothly and is firmly attached to the outer jaw 25A. It is needless to mention that, although the edge protector for bottom has been described above with reference to FIGS. 8 and 9, the same description is applicable also for the edge protector for the side.

When attaching edge protectors, each comprising an inner jaw, for attaching the mother blank to a side surface of the edge protector, formed in the longitudinal direction of the edge protector, and an outer jaw formed on the other side surface of the edge protector in the longitudinal direction of the edge protector, to the side edges and the lower edge of the mother blank, the spreader bar shown in FIG. 9 is attached to the outer jaw to tighten the mother blank in the inner jaw, and comprise a spreader bar having a narrow portion having a width smaller than that of the opening of the outer jaw, and a wide portion larger than the outer jaw, and a supporting member projecting in a direction perpendicular to the longitudinal direction of the outer jaw is provided on the spreader bar. Consequently, by inserting the narrow portion, smaller than the width of the opening of the outer jaw, in the longitudinal direction of the long spreader bar, into the opening in the outer jaw, and then turning the spreader bar around the axis of the supporting member, the outer jaw is opened, thereby clamping the inner jaw onto the mother blank.

Referring now to FIGS. 1 to 6 and 10, a spreader bar 40 shown in (FIGS. 1 to 6) for insertion into the outer jaw of the edge protector has an outside diameter smaller than the inside diameter of the outer jaws 25A and 25B. The material of the spreader bar 40 should have excellent corrosion resistance and have a large thermal coefficient of expansion. Suitable materials include, for example,low-density polyethylene, polypropylene, silicone resin and other synthetic resins.

After attaching the inner jaws 22A and 22B with the sealing member 30 against the mother blank 2, the spreader bar 40 is inserted in the longitudinal direction into the outer jaws 25A and 25B. Because the spreader bar 40 has an outside diameter smaller than the inside diameter of the outer jaws 25A and 25B, the spreader bar slides smoothly into the outer jaws 25A and 25B. When the mother blank and the edge protectors are immersed in a hot electrolytic cell, both the outer jaws 25A and 25B and the spreader bar 40 are heated to the electrolyte temperature (60° to 70° C.) and expand. The expansion of the spreader bar 40, in particular, expands the outer jaws 25A and 25B, to thereby clamp the inner jaws 22A and 22B on the mother blank 2. During this clamping action, sealing member 30 is compressed to provide a fluid-tight seal between the inner jaws 22A and 22B and the mother blank.

This embodiment of the invention, in which the unexpanded diameter of the spreader bar 40 is smaller than the diameter of the outer jaws 25A and 25B offers the possibility of inserting the spreader bar into the outer jaws 25A and 25B in a direction perpendicular to the longitudinal direction thereof. The subsequent expansion in the heated environment of the hot electrolytic cell provides the required clamping action. Attaching the spreader bar 40 is easier compared with the conventional case where the spreader bar 14 has a diameter larger than the inside diameter of the outer jaw 15.

The risk of the spreader bar 40 coming out of the outer jaws 25A and 25B larger early in the operation when thermal expansion is relied on to obtain tight clamping. This is especially true of the edge protectors for side 20A which are only loosely fitted into their respective outer jaws, and could easily slide downward. Thus, in this embodiment, means should be provided to prevent the spreader bar 40 from sliding from the lower end of the edge protector for side 20A. One technique for this is to arrange for the edge protector for bottom 20A to project beyond the ends of the edge protectors for side 20B. In an application which does not use an edge protector for bottom 20A such as, for example, in the case of a grooved mother blank, spreader bar 40 may include a flange portion at its upper end which supports the edge protector 20B. The spreader bar 40 may be made of a shape-memory alloy body covered with a flexible synthetic resin. The synthetic resin imparts its excellent corrosion resistance to the shape-memory alloy.

As described above, the present invention provides a method for attaching an edge protector to a mother blank for manufacturing a starting sheet, comprising an edge protector having an inner jaw, for attaching the mother blank on a side surface of a protector, formed in the longitudinal direction of the edge protector and an outer jaw, for attaching a spreader bar on the other side surface of the edge protector, formed in the longitudinal direction of the edge protector, to the both edges and/or to the lower edge of the mother blank, and comprises the steps of attaching the mother blank to the inner jaw, then, inserting the spreader bar having a diameter smaller than the diameter of the outer jaw into the outer jaw, and heating to expand the edge protector and the spreader bar by immersion in a hot electrolytic cell, thereby thermally expanding the spreader bar to attach the spreader bar in the outer jaw of the edge protector. Accordingly, insertion of the spreader bar into the outer jaw is enable because of the diameter of the spreader bar being smaller than the inner diameter of the outer jaw. Furthermore, heating and expansion of the outer jaw of the edge protector and the spreader bar in the electrolytic cell permit smooth and firm attachment of the spreader bar to the outer jaw of the edge protector. It is therefore possible to clamp the mother blank with the mother blank in close contact with the inner jaw. The edge protector according to this embodiment of the invention is serviceable for a long period of time in a sound state.

It is also evident that the high-thermal-expansion spreader bar of the edge protector of the present invention may also be used in conventional edge protectors as shown in FIGS. 13 and 14 with the same benefits as described above.

In the description of the spreader bar given above with reference to FIG. 9, an example has been disclosed in which the edge protector is clamped on the electrode for electrolysis by inserting a short spreader bar having a narrow portion smaller than the width of the opening of the outer jaw into the outer jaw at each of a plurality of positions in the longitudinal direction of a bar-shaped edge protector. The operating efficiency may be improved by using a spherical spreader bar having a spherical diameter larger than the inside diameter of the outer jaw. The spherical spreader bar may be inserted at high speed aided by a powered insertion means such as an air gun. That is, the present invention provides a spherical spreader bar larger than the inside diameter of the outer jaw and a method of inserting same at a high speed into the outer jaw using a powered insertion means.

Figure 19:
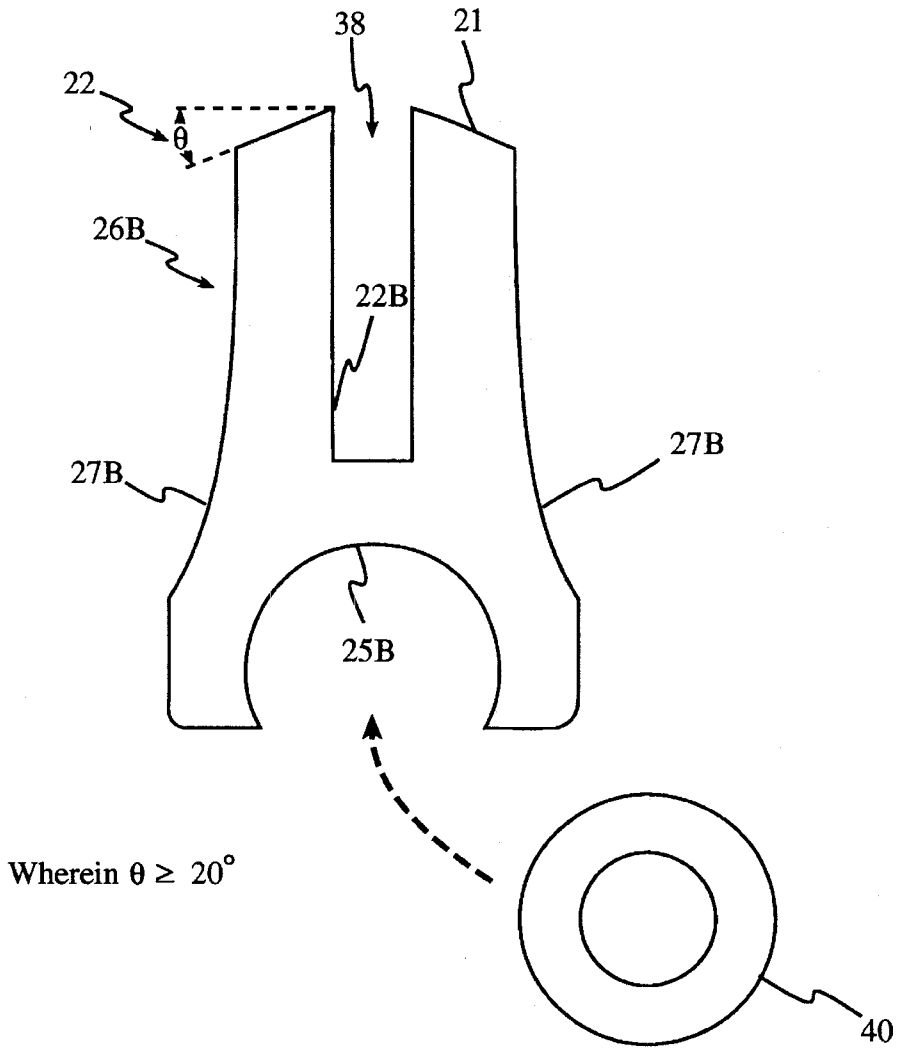
FIG. 19 is a side view illustrating an embodiment of edge protector the present invention, and a hollowed spreader bar for ready removable insertion therein, such as used when producing the product cathode of the present invention.

Referring now to FIG. 19, the B-type edge protector of the present invention as illustrated in FIG. 2 is shown. End 21 of the edge protector is angled in a sloping direction downward from inner edge 22B to 26B, such that problems of removability and inherent dangerousness are overcome. The angle of the slope, designated theta in this figure, is less than 20 degrees. This angle is marked by the number 22 in FIG. 19.

In this embodiment, for example, copper was electrodeposited on the electrolysis electrode until about 4.8 mm of thickness was achieved, using an edge protector having about 3.4 mm of thickness between 22B and 26B.

Hollowed spreader bar 40, is inserted into the outer jaws at 25B, while the deposited electrolytic copper is produced at the electrolysis electrode inserted in inner jaws 38. The hollowed spreader bar is an improvement over solid spreader bars because of its low production costs, the fact that it is capable of high speed extrusion and the fact that it requires no additional manpower. The lightweight and flexible nature of hollowed spreader bar 40, makes it easily insertable into the edge protector. The added malleability of the hollowed spreader bar 40, permits it to be inserted into the edge protector even when some difference in dimension exists between the hollowed bar 40, and the edge protector.

The hollowed spreader bar 40, as illustrated in FIG. 19, may for example, have an outer diameter of about 10 mm and a thickness of about 2 to 3 mm.

The present invention has been described above with reference to a mother blank for manufacturing a starting sheet to be used for electrolytic refining of copper. It will be clear to a person skilled in the art that the present invention is not limited to the electrolytic refining of copper, but may have more general applicability to any electrolytic process. The term "electrolytic process" as herein used includes both electrowinning and electro-refining, and further includes both the use of a starting sheet of the same metal as the electrodeposited metal and the use of a matrix cathode of a metal different from the electrodeposited metal, such as titanium, stainless steel or aluminum. The present invention is applied particularly usefully to the refining of copper, zinc, nickel and cobalt, using a starting sheet in an electrolytic process, and most satisfactorily applicable to a mother blank for manufacturing starting sheets of these metals. However the present invention is not limited to the cases shown but is useful as an edge protector even in electrolysis of copper, zinc, lead, nickel or cobalt using the above-mentioned matrix cathode.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

TABLE 1

| Shape | | Max. Temp. °C. | Max. thermal stress X-direction | Y-direction kgf/mm² | Equivalent vonmises tensile stress | Reduction of gap mm |
|---|---|---|---|---|---|---|
| Comparative sample | For bottom | 217.5 | 1.83 | 2.34 | 4.09 | 0.42 |
| | For side | 230.4 | 2.13 | 2.40 | 4.47 | 0.58 |
| Sample of the invention | For bottom | 167.7 | 1.36 | 1.65 | 2.97 | 0.31 |
| | For side | 186.3 | 1.52 | 1.55 | 3.47 | 0.39 |

TABLE 2

| | Sample No. | Number of treated heat cycles 56 | 59 | 74 | 80 | 133 | 192 | 235 |
|---|---|---|---|---|---|---|---|---|
| Conventional sample | 1-1 | 0/3 | 0/3 | 0/3 | 0/3 | 0/3 | 0/3 | — |
| | 1-2 | 0/3 | 0/3 | 0/3 | 1/3( 1) | 1/3( 1) | 2/3( 3) | — |
| | 1-3 | 0/3 | 0/3 | 0/3 | 0/3 | 1/3( 1) | 1/3( 1) | — |
| | 1-4 | 0/3 | 0/3 | 0/3 | 0/3 | 2/3( 2) | 2/3( 3) | — |
| | 2-1 | 0/3 | 0/3 | 0/3 | 0/3 | 0/3 | 0/3 | — |
| | 2-2 | 0/3 | 0/3 | 0/3 | 0/3 | 1/3( 3) | 1/3( 3) | — |
| | 2-3 | 0/3 | 0/3 | 0/3 | 0/3 | 0/3 | 0/3 | — |
| | 2-4 | 0/3 | 0/3 | 0/3 | 1/3( 1) | 1/3( 3) | 2/3( 4) | — |
| Sample of the invention | 3-1 | 0/3 | 0/3 | 0/3 | 0/3 | 0/3 | 0/3 | 0/3 |
| | 3-2 | 0/3 | 0/3 | 0/3 | 0/3 | 0/3 | 0/3 | 0/3 |
| | 3-3 | 0/3 | 0/3 | 0/3 | 0/3 | 0/3 | 0/3 | 0/3 |
| | 3-4 | 0/3 | 0/3 | 0/3 | 0/3 | 0/3 | 0/3 | 0/3 |
| | 4-1 | 0/3 | 0/3 | 0/3 | 0/3 | 0/3 | 0/3 | 0/3 |
| | 4-2 | 0/3 | 0/3 | 0/3 | 0/3 | 0/3 | 0/3 | 0/3 |
| | 4-3 | 0/3 | 0/3 | 0/3 | 0/3 | 0/3 | 0/3 | 0/3 |
| | 4-4 | 0/3 | 0/3 | 0/3 | 0/3 | 0/3 | 0/3 | 0/3 |

What is claimed is:

1. An edge protector for an electrolysis electrode comprising:

an inner jaw disposed in a longitudinal direction of said edge protector at a first end;

an outer jaw disposed in a longitudinal direction of said edge protector at a second end;

a first surface extending along a first side of said edge protector;

a second surface extending along a second side of said edge protector;

said first and second surfaces converging toward each other in a direction from said outer jaw toward said inner jaw, to reduce an amount of material in locations between said first and second surfaces sufficiently to reduce thermal stresses in said locations;

said first end further comprising opposing top and bottom portions of said inner jaw, wherein each said top and said bottom portion is angled upward from said first to said second surface;

said angle from said first surface of said edge protector to said second surface being an angle which is less than about twenty degrees from the center portion of the edge protector outward, formed at each said opposing top and bottom portion of said inner jaw, at a first end of said edge protector;

said angled first end of said edge protector effective for preventing unintended sharpening of said first end during electrolysis, and;

said edge protector is capable of ready removable detachment from said electrolysis electrode.

2. An edge protector according to claim 1, wherein said first and second surfaces include inclined planes.

3. An edge protector according to claim 1, wherein said first and second surfaces include concave curves.

4. An edge protector as claimed in claim 1, wherein said electrolysis electrode is used in production of a starting sheet for electrolytic refining of at least one metal selected from the group consisting of copper, zinc, lead, nickel, and cobalt.

5. An edge protector as claimed in claim 1, wherein said electrolysis electrode is used in production of an electrolytic copper product.

6. An edge protector as claimed in claim 1, wherein said electrolysis electrode is used in production of an electrolytic metal product, said metal being at least one metal selected from the group consisting of zinc, lead, nickel and cobalt.

7. An edge protector for an electrolysis electrode comprising:

an inner jaw disposed in a longitudinal direction of said edge protector;

an outer jaw disposed in a longitudinal direction of said edge protector; and a hollowed spreader bar, said bar having a hollowness disposed in a longitudinal direction;

said hollowed spreader bar capable of ready removable insertion into, and detachment from, said edge protector.

8. A hollowed spreader bar as claimed in claim 7, wherein said spreader bar is used for said edge protector used in production of an electrolytic copper product.

9. A hollowed spreader bar as claimed in claim 7, wherein said spreader bar is used for said edge protector used in production of an electrolytic metal product, said metal being at least one metal selected from the group consisting of zinc, lead, nickel and cobalt.

10. An edge protector of an electrolysis electrode for producing an electrolytic copper product comprising:

an inner jaw disposed in a longitudinal direction of said edge protector at a first end;

an outer jaw in a surface of said edge protector opposed to a surface containing said inner jaw at a second end;

a first surface extending along a first side of said edge protector;

a second surface extending along a second side of said edge protector;

said first and second surfaces converging toward each other in a direction from said outer jaw toward said inner jaw, to reduce an amount of material in locations between said first and second surfaces sufficiently to reduce thermal stresses in said locations;

a spreader bar;

means for permitting insertion of at least a portion of said spreader bar into said outer jaw without expansion thereof; and means for forcibly urging a portion of said spreader bar into contact with said outer jaw, whereby expansion of said outer jaw, and consequent urging of said inner jaw in a clamping direction is performed;

said first end further comprising opposing top and bottom portions of said inner jaw, wherein each said top and said bottom portion is angled upward from said first surface of said edge protector to said second surface, at an angle which is less than about twenty degrees is formed at a first end of said edge protector, at each said opposing top and bottom portion of said inner jaw, from each said first surface to each said second surface of each said portion from the center portion of the edge protector outward.

* * * * *